US011686307B2

(12) United States Patent
Lee et al.

(10) Patent No.: US 11,686,307 B2
(45) Date of Patent: Jun. 27, 2023

(54) COMPRESSOR HAVING OIL FEEDING CHANNELS

(71) Applicant: LG Electronics Inc., Seoul (KR)

(72) Inventors: Kyungho Lee, Seoul (KR); Minho Lee, Seoul (KR); Kangwook Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/235,289

(22) Filed: Apr. 20, 2021

(65) Prior Publication Data

US 2021/0324856 A1 Oct. 21, 2021

(30) Foreign Application Priority Data

Apr. 20, 2020 (KR) ..... 10-2020-0047699

(51) Int. Cl.
*F04C 18/02* (2006.01)
*F04C 29/12* (2006.01)
(Continued)

(52) U.S. Cl.
CPC ..... *F04C 18/0253* (2013.01); *F04C 18/0215* (2013.01); *F04C 18/0261* (2013.01); *F04C 18/0292* (2013.01); *F04C 29/02* (2013.01); *F04C 29/023* (2013.01); *F04C 29/12* (2013.01); *F04C 23/008* (2013.01); *F04C 2210/26* (2013.01); *F04C 2240/30* (2013.01); *F04C 2240/603* (2013.01); *F04C 2240/809* (2013.01);
(Continued)

(58) Field of Classification Search
CPC ..... F04C 18/0253; F04C 18/0215; F04C 18/0261; F04C 18/0292; F04C 29/02; F04C 29/023; F04C 29/12; F04C 23/008; F04C 2210/26; F04C 2240/30; F04C 2240/603; F04C 2240/809; F04C 2250/102; F05B 2260/98
See application file for complete search history.

(56) References Cited

U.S. PATENT DOCUMENTS

2013/0078131 A1* 3/2013 Ahn ..... F04C 18/0215 418/55.6
2016/0377081 A1 12/2016 Cho et al.
(Continued)

FOREIGN PATENT DOCUMENTS

EP 1160453 A1 * 12/2001 ..... F04C 23/008
EP 3418574 12/2018
(Continued)

OTHER PUBLICATIONS

KR Office Action in Korean Appln. No. 10-2020-0047699, dated May 6, 2021, 13 pages (with English translation).
(Continued)

*Primary Examiner* — Dominick L Plakkoottam
*Assistant Examiner* — Paul W Thiede
(74) *Attorney, Agent, or Firm* — Fish & Richardson P.C.

(57) ABSTRACT

A scroll type compressor includes an orbiting scroll including an orbiting wrap and a fixed scroll including a fixed wrap, in which first and second oil channels are respectively configured to supply oil to inner and outer oil channels formed by the orbiting wrap and the fixed wrap. Thus, the scroll type compressor has an oil channel structure that allows oil feeding into to the scrolls.

10 Claims, 9 Drawing Sheets

(51) Int. Cl.
*F04C 29/02* (2006.01)
*F04C 23/00* (2006.01)

(52) U.S. Cl.
CPC ..... *F04C 2250/102* (2013.01); *F05B 2260/98* (2013.01)

(56) References Cited

U.S. PATENT DOCUMENTS

| | | | | |
|---|---|---|---|---|
| 2018/0372103 | A1* | 12/2018 | Choi | F04C 27/005 |
| 2020/0088199 | A1* | 3/2020 | Lee | F04C 23/008 |

FOREIGN PATENT DOCUMENTS

| | | | | |
|---|---|---|---|---|
| EP | 3418575 | A1 * | 12/2018 | F04B 39/0246 |
| EP | 3553318 | | 10/2019 | |
| EP | 3719319 | | 10/2020 | |
| JP | H05157069 | | 6/1993 | |
| JP | H09144675 | | 6/1997 | |
| JP | 6344452 | | 6/2018 | |
| KR | 1020180091577 | | 8/2018 | |
| KR | 1020180101901 | | 9/2018 | |
| KR | 10-2018-0124636 | | 11/2018 | |
| WO | WO2010070790 | | 5/2012 | |

OTHER PUBLICATIONS

Extended European Search Report in European Appln. No. 21168235.6, dated Jul. 16, 2021, 9 pages.

* cited by examiner

FIG. 8A
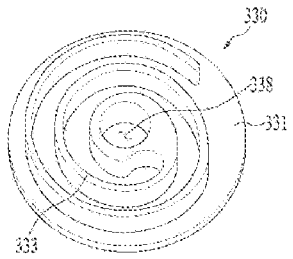
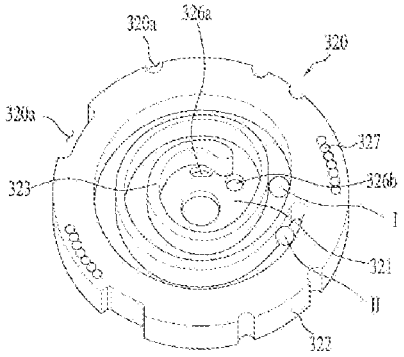
FIG. 8B
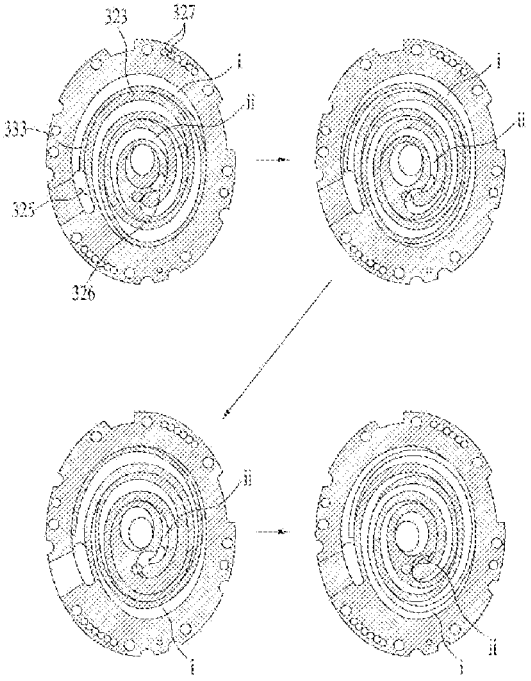
FIG. 8C

COMPRESSOR HAVING OIL FEEDING CHANNELS

CROSS-REFERENCE TO RELATED APPLICATIONS

This application claims the benefit of Korean Patent Application No. 10-2020-0047699, filed on Apr. 20, 2020, which is hereby incorporated by reference as when fully set forth herein.

TECHNICAL FIELD

The present disclosure relates to a compressor. More specifically, the present disclosure relates to a scroll type compressor having an oil feeding channel capable of supplying oil to a compressing assembly in which refrigerant is compressed.

BACKGROUND

Generally, a compressor is an apparatus applied to a refrigeration cycle such as a refrigerator or an air conditioner, which compresses refrigerant to provide work necessary to generate heat exchange in the refrigeration cycle.

The compressors may be classified into a reciprocating type compressor, a rotary type compressor, and a scroll type compressor based on a scheme in which the refrigerant is compressed. In the scroll type compressor, while an orbiting scroll is engaged with a fixed scroll fixed in an internal space of a sealed container, the orbiting scroll orbits, thereby to define a compression chamber between a fixed wrap of the fixed scroll and an orbiting wrap of the orbiting scroll.

Compared with other types of the compressors, the scroll type compressor may obtain a relatively high compression ratio because the refrigerant is continuously compressed using the scrolls engaged with each other, and may obtain a stable torque because suction, compression, and discharge of the refrigerant proceed smoothly. For this reason, the scroll type compressor is widely used for compressing the refrigerant in the air conditioner and the like.

Referring to Japanese Patent No. 6344452, a conventional scroll type compressor includes a casing forming an outer shape of the compressor and having a discharger for discharging refrigerant, a compression assembly fixed to the casing to compress the refrigerant, and a driver fixed to the casing to drive the compression assembly, wherein the compression assembly and the driver are coupled to a rotatable shaft that is coupled to the driver and rotates.

The compression assembly includes a fixed scroll fixed to the casing and having a fixed wrap, and an orbiting scroll including an orbiting wrap orbiting in a state of being engaged with the fixed wrap via the rotatable shaft. In the conventional scroll type compressor, the rotatable shaft is eccentric, and the orbiting scroll is fixed to the eccentric rotatable shaft and orbits. Thus, the orbiting scroll orbits along the fixed scroll to compress the refrigerant.

In the conventional scroll type compressor, the compression assembly is generally disposed below the discharger, and the driver is generally disposed below the compression assembly. Further, the rotatable shaft generally has one end coupled to the compression assembly and the other end passing through the driver.

The conventional scroll type compressor has difficulty in supplying oil into the compression assembly because the compression assembly is disposed above the driver and is closer to the discharger. Further, an additional lower frame under the driver is required to separately support the rotatable shaft connected to the compression assembly. Further, in the conventional scroll compressor, because action points of a gas force generated via the compression of the refrigerant and a reaction force supporting the gas force do not coincide with each other within the compression assembly, the orbiting scroll tilts, resulting in a problem of lowering efficiency and reliability thereof.

In order to solve such problems, referring to Korean Patent Application Publication No. 10-2018-0124636, in recent years, a scroll type compressor (also known as a lower scroll type compressor or a shaft-through scroll type compressor) having the driver below the discharger and having the compression assembly below the driver has emerged.

The shaft-through scroll type compressor has the advantage of smooth oil supply since the compressing assembly 300 is closer to an oil storage space than the driver is. Further, since the compressing assembly 300 itself supports the rotatable shaft extending from the driver, a structure for separately supporting the rotatable shaft may be omitted, thereby simplifying a structure thereof.

Further, when the rotatable shaft extends through an entirety of the compressing assembly 300, the rotatable shaft supports vibration or pressure generated in the compressing assembly 300 in a longitudinal direction, thereby improving the reliability of the compressor.

FIGS. 1A and 1B show a detailed structure of the compressing assembly of the conventional compressor.

Referring to FIG. 1A, the compressing assembly may include an orbiting scroll 330 that rotatably accommodates a rotatable shaft 230, and a fixed scroll 320 engaging with the orbiting scroll to form a compression chamber in which the refrigerant is compressed, and a main frame 310 mounted on the fixed scroll 320 to accommodate the orbiting scroll 330 therein.

The rotatable shaft 230 may include an eccentric shaft 232 having an diameter expanding in a biased manner as accommodated in the orbiting scroll 330. Accordingly, as the rotatable shaft 230 rotates, the eccentric shaft 232 presses the orbiting scroll 330 along a circumference of the fixed scroll 320 to continuously compress the refrigerant flowing along the orbiting scroll 330 and the fixed scroll 320.

Since the orbiting scroll 330 and the fixed scroll 320 may cause friction therebetween in the process of compressing the refrigerant, and may be overheated as the temperature of the refrigerant increases, the conventional compressor may further include an oil feeding channel passing through the rotatable shaft 230 and the main frame 310 and the fixed scroll 320. The oil feeding channel I extends to an area facing the orbiting wrap 333 of the orbiting scroll 330 to deliver the oil to the compression chamber.

In order to smoothly supply the oil to the orbiting wrap 333, an outlet of the oil feeding channel I may be disposed at one of an inner channel A spaced from an inner face of the orbiting wrap 333 or an outer channel B spaced from an outer face of the orbiting wrap 333.

However, the inner channel A and the outer channel B may be selectively blocked as the orbiting wrap 333 moves according to the rotation of the eccentric shaft 232. For example, when the outlet of the oil feeding channel I is disposed at the outer channel B, and when the orbiting wrap 333 moves to the outlet of the oil feeding channel I, the oil feeding channel I may be closed such that the oil feeding is stopped.

FIG. 1B shows an oil feeding pressure according to an angle at which the orbiting wrap 333 extends in a direction in which the orbiting wrap 333 accommodates the rotatable shaft 230 relative to a refrigerant intake hole of the fixed scroll through which the refrigerant is sucked.

Referring to a graph FIG. 1B, it may be seen that oil is supplied to the outer channel B in a section of 0 to 30 degrees and a section of 270 degrees to 360 degrees, while the oil is supplied to the inner channel A in a section of 70 to 220 degrees. However, it may be seen that the oil feeding channel I is closed by the orbiting wrap 333 so that the oil feeding is stopped in a section between 30 degrees and 70 degrees and a section between 220 degrees and 270 degrees.

Thus, the conventional compressor has a problem in that the oil feeding stops in the specific section, so that the oil cannot be fed to the entire compressor. Further, there is a problem in that the reliability of the compressor cannot be guaranteed due to structural limitations such as severe wear and damage in the specific section.

SUMMARY

A purpose of the present disclosure is to provide a scroll type compressor in which both of outlets for feeding oil into a region between the orbiting scroll and the fixed scroll may be prevented from being blocked even when the orbiting scroll moves by the rotatable shaft.

A purpose of the present disclosure is to provide a scroll type compressor in which a plurality of oil channels to supply oil are defined to prevents oil feeding from being interrupted.

A purpose of the present disclosure is to provide a scroll type compressor in which all of a plurality of oil channels for supplying oil may be prevented from being blocked no matter where the orbiting scroll is positioned.

A purpose of the present disclosure is to provide a scroll type compressor having oil feeding channels for feeding the oil to the inner and outer faces of the orbiting wrap of the orbiting scroll.

A purpose of the present disclosure is to provide a scroll type compressor in which a plurality of oil feeding channels may be defined in on a main scroll and a fixed scroll, or a plurality of oil feeding channels may be defined in the orbiting scroll.

The present disclosure provides a compressor having a first oil channel supplying oil to a compression chamber formed by an orbiting scroll and a fixed scroll, and a second oil channel spaced from the first oil channel to feed the oil.

Each of the first oil channel and the second oil channel may act as each direct oil injection channel. That is, each of the oil feeding lines before a crank angle 0° may be formed such that each of oil feeding lines to each of compression chambers may be created.

The first oil channel and the second oil channel may be arranged such that oil feeding through at least one of the first oil channel or the second oil channel is always available. Therefore, a structure capable of always feeding the oil into all regions of the compression chamber may be formed.

In the compressor according to the present disclosure, the first oil channel may act as an oil feeding channel having a conventional differential pressure oil feeding structure, and the second oil channel may act as a lower pressure ratio oil feeding channel. Therefore, the oil feeding under the normal operation range and the oil feeding under the lower pressure ratio may also be performed at the same time. The lower pressure power ratio oil feeding line may be constructed to communicate with the refrigerant inlet for smooth oil feeding even at a pressure ratio of 1.1 or lower. Further, the oil feeding line for direct injection of oil to the inlet after decompression via a decompression pin for the oil of the oil storage as the discharge pressure space may be formed. As a result, the low pressure ratio region oil feeding amount may be improved and bearing reliability may be secured. In this connection, the compressor according to the present disclosure may be constructed to improve the oil feeding amount by securing the differential pressure amount via adjustment of the oil feeding communication angle (for example, before start angle 0° C.). Further, the compressor according to the present disclosure may be constructed to secure bearing reliability during low pressure ratio operation by securing an oil feeding amount to prevent abnormal behavior of the orbiting scroll by improving the intermediate pressure of the orbiting scroll. Therefore, it is possible to improve the oil feeding efficiency under the lower pressure force ratio.

Further, the compressor according to the present disclosure may secure the reliability of the compressor via the dual oil feeding channels that may allow always-oil feeding. One of the first oil channel and the second oil channel may be defined as a communication hole that may be always opened. Thus, a structure in which oil feeding is always possible may be implemented.

In one example, the first oil channel and the second oil channel may supply oil to different regions. The first oil channel and the second oil channel may be constructed to be spaced apart from each other by a spacing larger than a thickness of the orbiting wrap, and may be located in positions at which both of the first oil channel and the second oil channel are prevented from being simultaneously closed by the orbiting wrap or the fixed wrap.

The outlet of the first oil channel may be closer to the refrigerant discharge hole or the rotatable shaft than the outlet of the second oil channel may be. In one example, the second oil channel may supply oil to a relatively lower pressure region, and the first oil channel may supply oil to a relatively high pressure region.

Accordingly, when oil is not supplied to the high pressure region, oil may be supplied to the lower pressure region. Alternatively, when oil is not supplied to the lower pressure region, oil may be supplied to the high pressure region.

Further, even when the orbiting wrap moves and closes the first oil channel, the second oil channel may be opened. Alternatively, even when the orbiting wrap moves and closes the second oil channel, the first oil channel may be opened. As a result, a state in which the oil is fed to the inside of the compressor may always be maintained.

The scroll type compressor may have a first oil channel located inside the orbiting scroll and a second channel located outside the orbiting scroll.

In one embodiment, a compressor includes a casing including a discharger to discharge refrigerant, and an oil storage space for storing oil therein; a driver coupled to an inner circumferential face of the casing; a rotatable shaft coupled to the driver and constructed to supply the oil; and a compressing assembly coupled to the rotatable shaft to compress the refrigerant, wherein the compressing assembly is lubricated with the oil.

The compressing assembly includes: an orbiting scroll including: an orbiting end plate supporting the rotatable shaft rotatably and performing an orbiting motion; and an orbiting wrap extending along a circumference of the orbiting end plate to compress the refrigerant; a fixed scroll including: a fixed end plate having a refrigerant inlet and a discharge hole defined therein, wherein the discharge hole is spaced from the inlet and discharges the compressed refrigerant; and a fixed wrap extending along the orbiting wrap and on the fixed end plate to compress the refrigerant; a main frame mounted on the fixed end plate to accommodate therein the orbiting scroll, wherein the rotatable shaft passes through the main frame; and an oil feeding channel passing through the orbiting end plate or the fixed end plate and feeding the oil delivered from the rotatable shaft into a region between the orbiting wrap and the fixed wrap.

The oil feeding channel includes: a first oil channel constructed to supply the oil in a first region between the fixed wrap and the orbiting wrap; and a second oil channel separated from the first oil channel or branched from the first oil channel to supply the oil to a second region other than the first region, wherein a spacing between an outlet of the first oil channel and the rotatable shaft is smaller than a spacing between an outlet of the second oil channel and the rotatable shaft.

In another embodiment, in the compressor according to the present disclosure, the first oil channel and the second oil channel may pass through the orbiting end plate, and the outlet of the first oil channel and the outlet of the second oil channel may be defined in the orbiting end plate.

The present disclosure has the effect that the oil feeding may be prevented from being stopped regardless of the position of the orbiting scroll.

The present disclosure has the effect that oil feeding may always be performed no matter where the orbiting scroll is located.

The present disclosure is effective in preventing compressor wear and overheating by maintaining the oil supply to all of the oil channels formed by the orbiting wrap and the fixed wrap.

BRIEF DESCRIPTION OF DRAWINGS

FIGS. 8A to 8C show how the compressor according to the present disclosure works.

DETAILED DESCRIPTION

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure. Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims. The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof.

Figure 1B:
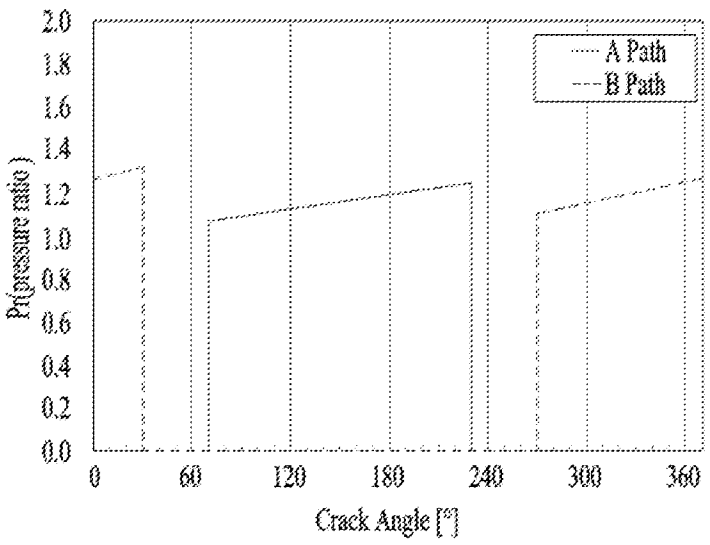
Prior Art FIG. 1B
FIGS. 1A and 1B show the structure of the conventional compressor compressing assembly.
Figure 1A:
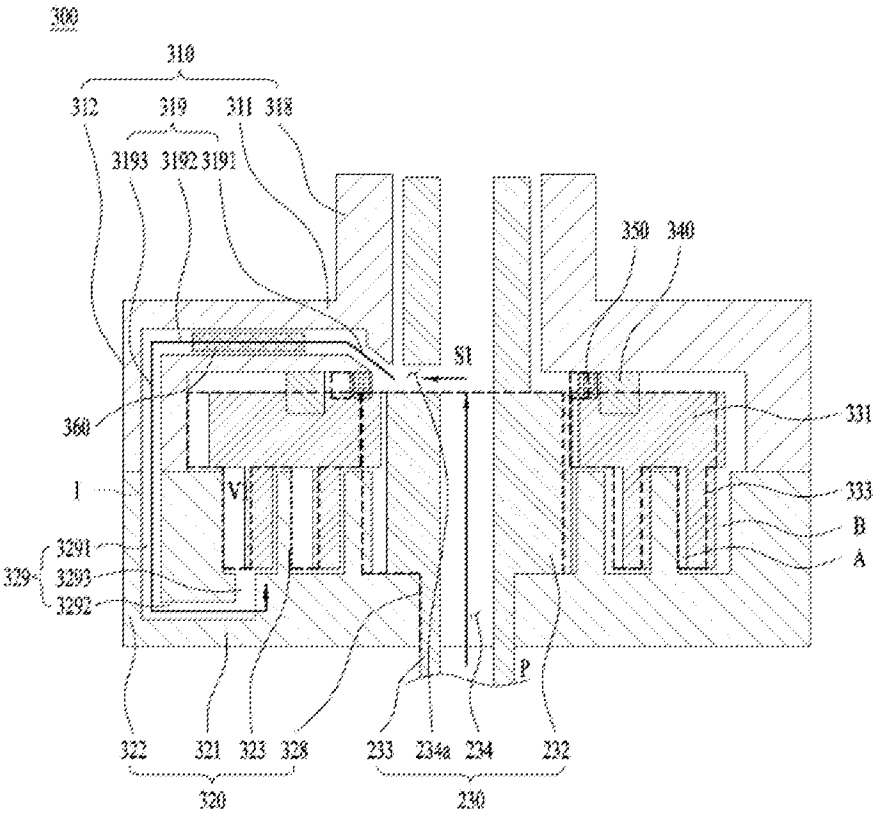
Prior Art FIG. 1A
Figure 2:
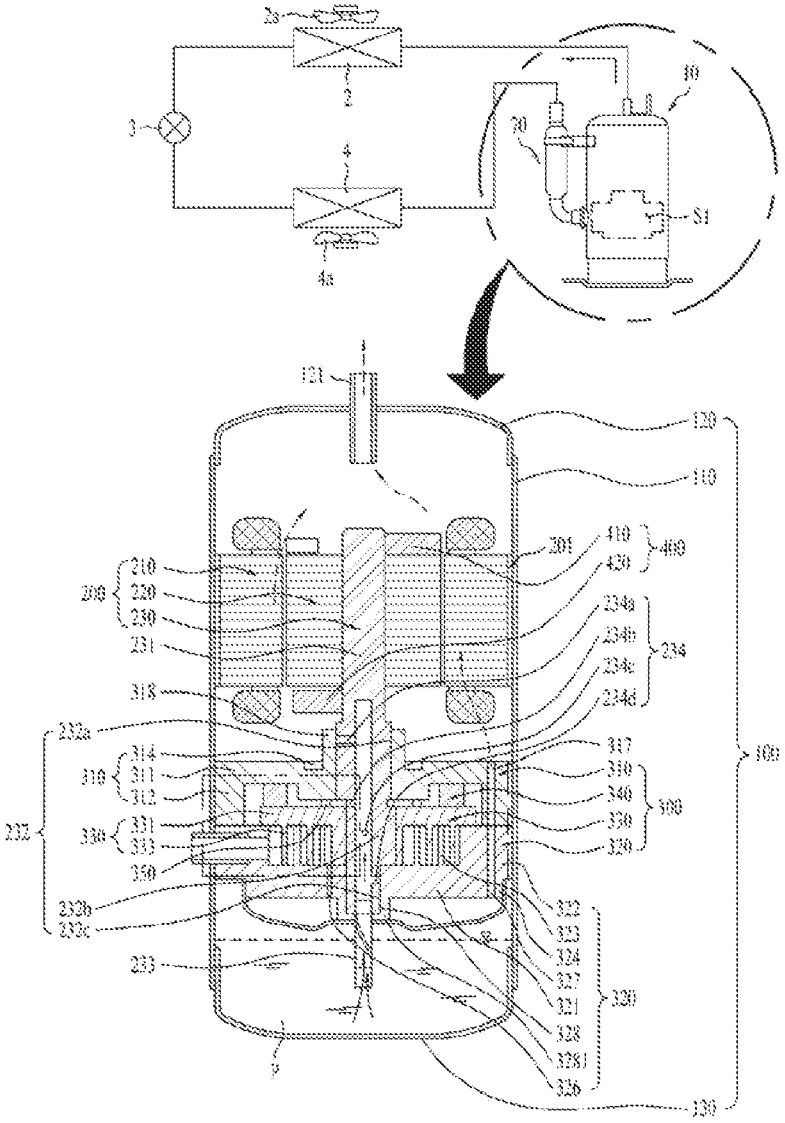
FIG. 2 shows a basic structure of a compressor according to the present disclosure.

FIG. 2 describes the basic structure of the compressor of one embodiment of the present disclosure. A scroll type compressor 10 according to the present disclosure is generally installed on a circuit of a refrigerant cycle having a condenser 2, an expansion valve 3, and an evaporator 4.

Referring to FIG. 2, the scroll type compressor 10 according to an embodiment of the present disclosure may include a casing 100 having therein a space in which fluid is stored or flows, a driver 200 coupled to an inner circumferential face of the casing 100 to rotate a rotatable shaft 230, and a compression assembly 300 coupled to the rotatable shaft 230 inside the casing and compressing the fluid.

Specifically, the casing 100 may include a discharger 121 through which refrigerant is discharged at one side. The casing 100 may include a receiving shell 110 formed in a cylindrical shape to receive the driver 200 and the compression assembly 300 therein, a discharge shell 120 coupled to one end of the receiving shell 110 and having the discharger 121, and a sealing shell 130 coupled to the other end of the receiving shell 110 to seal the receiving shell 110.

The driver 200 includes a stator 210 for generating a rotating magnetic field, and a rotor 220 constructed to rotate by the rotating magnetic field. The rotatable shaft 230 may be coupled to the rotor 220 to be rotated together with the rotor 220.

The stator 210 has a plurality of slots defined in an inner circumferential face thereof along a circumferential direction and a coil is wound around the plurality of slots. Further, the stator 210 may be fixed to an inner circumferential face of the receiving shell 110. A permanent magnet may be coupled to the rotor 220, and the rotor 220 may be rotatably coupled within the stator 210 to generate rotational power. The rotatable shaft 230 may be pressed into and coupled to a center of the rotor 220.

The compression assembly 300 may include a fixed scroll 320 coupled to the receiving shell 110 and disposed in a direction away from the discharger 121 with respect to the driver 200, an orbiting scroll 330 coupled to the rotatable shaft 230 and engaged with the fixed scroll 320 to define a compression chamber, and a main frame 310 accommodating the orbiting scroll 330 therein and seated on the fixed scroll 320 to form an outer shape of the compression assembly 330.

As a result, the lower scroll type compressor 10 has the driver 200 disposed between the discharger 120 and the compression assembly 300. In other words, the driver 200 may be disposed at one side of the discharger 120, and the compression assembly 300 may be disposed in a direction away from the discharger 121 with respect to the driver 200. For example, when the discharger 121 is disposed above the casing 100, the compression assembly 300 may be disposed below the driver 200, and the driver 200 may be disposed between the discharger 120 and the compression assembly 300.

Thus, when oil is stored in an oil storage space p of the casing 100, the oil may be supplied directly to the compression assembly 300 without passing through the driver 200. In addition, since the rotatable shaft 230 is coupled to and supported by the compression assembly 300, a lower frame for rotatably supporting the rotatable shaft may be omitted.

In one example, the lower scroll type compressor 10 according to the present disclosure may be configured such that the rotatable shaft 230 passes through not only the orbiting scroll 330 but also the fixed scroll 320 to be in face contact with both the orbiting scroll 330 and the fixed scroll 320.

As a result, an inflow force generated when the fluid such as the refrigerant is flowed into the compression assembly 300, a gas force generated when the refrigerant is compressed in the compression assembly 300, and a reaction force for supporting the same may be directly exerted on the rotatable shaft 230. Accordingly, the inflow force, the gas force, and the reaction force may be exerted to a point of application of the rotatable shaft 230. As a result, since a tilting moment does not act on the orbiting scroll 320 coupled to the rotatable shaft 230, tilting or overturn of the orbiting scroll may be blocked. In other words, tilting in an axial direction of the tilting may be attenuated or prevented, and the overturn moment of the orbiting scroll 330 may also be attenuated or suppressed. As a result, noise and vibration generated in the lower scroll type compressor 10 may be blocked. In addition, the fixed scroll 320 is in face contact with and supports the rotatable shaft 230, so that durability of the rotatable shaft 230 may be reinforced even when the inflow force and the gas force act on the rotatable shaft 230. In addition, a backpressure generated while the refrigerant is discharged to outside is also partially absorbed or supported by the rotatable shaft 230, so that a force (normal force) in which the orbiting scroll 330 and the fixed scroll 320 become excessively close to each other in the axial direction may be reduced. As a result, a friction force between the orbiting scroll 330 and the fixed scroll 230 may be greatly reduced.

As a result, the compressor 10 attenuates the tilting in the axial direction and the overturn or tilting moment of the orbiting scroll 330 inside the compression assembly 300 and reduces the frictional force of the orbiting scroll, thereby increasing an efficiency and a reliability of the compression assembly 300.

In one example, the main frame 310 of the compression assembly 300 may include a main end plate 311 disposed at one side of the driver 200 or at a lower portion of the driver 300, a main side plate 312 extending in a direction farther away from the driver 200 from an inner circumferential face of the main end plate 311 and seated on the fixed scroll 330, and a main shaft receiving portion 318 extending from the main end plate 311 to rotatably support the rotatable shaft 230.

A main hole 317 for guiding the refrigerant discharged from the fixed scroll 320 to the discharger 121 may be further defined in the main end plate 311 or the main side plate 312.

The main end plate 311 may further include an oil pocket 314 that is engraved in an outer face of the main shaft receiving portion 318. The oil pocket 314 may be defined in an annular shape, and may be defined to be eccentric to the main shaft receiving portion 318. When the oil stored in the sealing shell 130 is transferred through the rotatable shaft 230 or the like, the oil pocket 314 may be defined such that the oil is supplied to a portion where the fixed scroll 320 and the orbiting scroll 330 are engaged with each other.

The fixed scroll 320 may include a fixed end plate 321 coupled to the receiving shell 110 in a direction away from the driver 300 with respect to the main end plate 311 to form the other face of the compression assembly 300, a fixed side plate 322 extending from the fixed end plate 321 to the discharger 121 to be in contact with the main side plate 312, and a fixed wrap 323 disposed on an inner circumferential face of the fixed side plate 322 to define the compression chamber in which the refrigerant is compressed.

In one example, the fixed scroll 320 may include a fixed through-hole 328 defined to pass through the rotatable shaft 230, and a fixed shaft receiving portion 3281 extending from the fixed through-hole 328 such that the rotatable shaft is rotatably supported. The fixed shaft receiving portion 3331 may be disposed at a center of the fixed end plate 321.

A thickness of the fixed end plate 321 may be equal to a thickness of the fixed shaft receiving portion 3381. In this case, the fixed shaft receiving portion 3281 may be inserted into the fixed through-hole 328 instead of protruding from the fixed end plate 321.

The fixed side plate 322 may include an inflow hole 325 defined therein for flowing the refrigerant into the fixed wrap 323, and the fixed end plate 321 may include discharge hole 326 defined therein through which the refrigerant is discharged. The discharge hole 326 may be defined in a center direction of the fixed wrap 323, or may be spaced apart from the fixed shaft receiving portion 3281 to avoid interference with the fixed shaft receiving portion 3281, or the discharge hole 326 may include a plurality of discharge holes.

The fixed scroll may have a bypass hole 327 defined therein through which the refrigerant discharged from the discharge port 326 is discharged. The bypass hole 327 may pass through the fixed end plate 321.

Further, the fixed scroll 320 may further include a stepped face 324 extending in a stepwise manner from the fixed end plate 321 or the fixed side plate 322 in order to couple a muffler to be described late thereto. A diameter of the stepped face 324 may be smaller than a diameter of the fixed end plate 321.

The orbiting scroll 330 may include an orbiting end plate 331 disposed between the main frame 310 and the fixed scroll 320, and an orbiting wrap 333 disposed below the orbiting end plate to define the compression chamber together with the fixed wrap 323 in the orbiting end plate.

The orbiting scroll 330 may further include an orbiting through-hole 338 defined through the orbiting end plate 331 to rotatably couple the rotatable shaft 230.

The rotatable shaft 230 may be constructed such that a portion thereof coupled to the orbiting through-hole 338 is eccentric. Thus, when the rotatable shaft 230 rotates, the orbiting scroll 330 orbits in a state of being engaged with the fixed wrap 323 of the fixed scroll 320 to compress the refrigerant.

Specifically, the rotatable shaft 230 may include a main shaft 231 coupled to the driver 200 and rotating, and a support shaft 232 connected to the main shaft 231 and rotatably coupled to the compression assembly 300. The support shaft 232 may be included as a member separate from the main shaft 231, and may accommodate the main shaft 231 therein, or may be integrated with the main shaft 231.

The support shaft 232 may include a main support shaft 232*c* inserted into the main shaft receiving portion 318 of the main frame 310 and rotatably supported, a fixed support shaft 232*a* inserted into the fixed shaft receiving portion 3281 of the fixed scroll 320 and rotatably supported, and an eccentric shaft 232*b* disposed between the main support shaft 232*c* and the fixed support shaft 232*a*, and inserted into the orbiting through-hole 338 of the orbiting scroll 330 and rotatably supported.

In this connection, the main support shaft 232*c* and the fixed support shaft 232*a* may be coaxial to have the same axis center, and the eccentric shaft 232*b* may be formed such that a center of gravity thereof is radially eccentric with respect to the main support shaft 232*c* or the fixed support shaft 232*a*. In addition, the eccentric shaft 232*b* may have an outer diameter greater than an outer diameter of the main support shaft 232*c* or an outer diameter of the fixed support shaft 232*a*. As such, the eccentric shaft 232*b* may provide a force to compress the refrigerant while orbiting the orbiting scroll 330 when the support shaft 232 rotates, and the orbiting scroll 330 may be constructed to regularly orbit the fixed scroll 320 by the eccentric shaft 232*b*.

However, in order to prevent the orbiting scroll 320 from spinning, the compressor 10 according to the present disclosure may further include an Oldham's ring 340 coupled to an upper portion of the orbiting scroll 320. The Oldham's ring 340 may be disposed between the orbiting scroll 330 and the main frame 310 to be in contact with both the orbiting scroll 330 and the main frame 310. The Oldham's ring 340 may be constructed to linearly move in four directions of front, rear, left, and right directions to prevent the rotation of the orbiting scroll 320.

In one example, the rotatable shaft 230 may be constructed to completely pass through the fixed scroll 320 to protrude out of the compression assembly 300. As a result, the rotatable shaft 230 may be in direct contact with outside of the compression assembly 300 and the oil stored in the sealing shell 130. The rotatable shaft 230 may supply the oil into the compression assembly 300 while rotating.

The oil may be supplied to the compression assembly 300 through the rotatable shaft 230. An oil supply channel 234 for supplying the oil to an outer circumferential face of the main support shaft 232*c*, an outer circumferential face of the fixed support shaft 232*a*, and an outer circumferential face of the eccentric shaft 232*b* may be formed at or inside the rotatable shaft 230.

In addition, a plurality of oil feed holes 234*a*, 234*b*, 234*c*, and 234*d* may be defined in the oil supply channel 234. Specifically, the oil feed hole may include a first oil feed hole 234*a*, a second oil feed hole 234*b*, a third oil feed hole 234*c*, and a fourth oil feed hole 234*d*. First, the first oil feed hole 234*a* may be defined to pass through the outer circumferential face of the main support shaft 232*c*. The third oil feed hole 234*c* may be defined in a feed groove 2341*c*.

The first oil feed hole 234*a* may be defined to pass through into the outer circumferential face of the main support shaft 232*c* in the oil supply channel 234. In addition, the first oil feed hole 234*a* may be defined to, for example, pass through an upper portion of the outer circumferential face of the main support shaft 232*c*, but is not limited thereto. That is, the first oil feed hole 234*a* may be defined to pass through a lower portion of the outer circumferential face of the main support shaft 232*c*. For reference, unlike as shown in the drawing, the first oil feed hole 234*a* may include a plurality of holes. In addition, when the first oil feed hole 234*a* includes the plurality of holes, the plurality of holes may be defined only in the upper portion or only in the lower portion of the outer circumferential face of the main support shaft 232*c*, or may be defined in both the upper and lower portions of the outer circumferential face of the main support shaft 232*c*.

In addition, the rotatable shaft 230 may include an oil shaft 233 passing through the muffler to be described later to be in contact with the stored oil of the casing 100. The oil shaft 233 may include an extension shaft 233*a* passing through the muffler and in contact with the oil, and a spiral groove 233*b* spirally defined in an outer circumferential face of the extension shaft 233*a* and in communication with the supply channel 234.

Thus, when the rotatable shaft 230 is rotated, due to the spiral groove 233*b*, a viscosity of the oil, and a pressure difference between a high pressure region S1 and an intermediate pressure region V1 inside the compression assembly 300, the oil rises through the oil shaft 233 and the supply channel 234 and is discharged into the plurality of oil feed holes. The oil discharged through the plurality of oil feed holes 234*a*, 234*b*, 234*c*, and 234*d* not only maintains an airtight state by forming an oil film between the fixed scroll 250 and the orbiting scroll 240, but also absorbs frictional heat generated at friction portions between the components of the compression assembly 300 and discharge the heat.

The oil guided along the rotatable shaft 230 and supplied through the first oil feed hole 234*a* may lubricate the main frame 310 and the rotatable shaft 230. In addition, the oil may be discharged through the second oil feed hole 234*b* and supplied to a top face of the orbiting scroll 240, and the oil supplied to the top face of the orbiting scroll 240 may be guided to the intermediate pressure region through the pocket groove 314. For reference, the oil discharged not only through the second oil feed hole 234*b* but also through the first oil feed hole 234*a* or the third oil feed hole 234*c* may be supplied to the pocket groove 314.

In one example, the oil guided along the rotatable shaft 230 may be supplied to the Oldham's ring 340 and the fixed side plate 322 of the fixed scroll 320 installed between the orbiting scroll 240 and the main frame 230. Thus, wear of the fixed side plate 322 of the fixed scroll 320 and the Oldham's ring 340 may be reduced. In addition, the oil supplied to the third oil feed hole 234*c* is supplied to the compression chamber to not only reduce wear due to friction between the orbiting scroll 330 and the fixed scroll 320, but also form the oil film and discharge the heat, thereby improving a compression efficiency.

Although a centrifugal oil feed structure in which the lower scroll type compressor 10 uses the rotation of the rotatable shaft 230 to supply the oil to the bearing has been described, the centrifugal oil feed structure is merely an example. Further, a differential pressure supply structure for supplying oil using a pressure difference inside the compression assembly 300 and a forced oil feed structure for supplying oil through a toroid pump, and the like may also be applied.

In one example, the compressed refrigerant is discharged to the discharge hole 326 along a space defined by the fixed wrap 323 and the orbiting wrap 333. The discharge hole 326 may be more advantageously disposed toward the discharger 121. This is because the refrigerant discharged from the discharge hole 326 is most advantageously delivered to the discharger 121 without a large change in a flow direction.

However, because of structural characteristics that the compression assembly 300 is positioned in a direction away from the discharger 121 with respect to the driver 200, and that the fixed scroll 320 should be disposed at an outermost portion of the compression assembly 300, the discharge hole 326 is constructed to spray the refrigerant in a direction opposite to a direction toward the discharger 121.

In other words, the discharge hole 326 is defined to spray the refrigerant in a direction away from the discharger 121 with respect to the fixed end plate 321. Therefore, when the refrigerant is sprayed into the discharge hole 326 as it is, the refrigerant may not be smoothly discharged to the discharger 121, and when the oil is stored in the sealing shell 130, the refrigerant may collide with the oil and be cooled or mixed.

In order to prevent this problem, the compressor 10 in accordance with the present disclosure may further include the muffler coupled to an outermost portion of the fixed scroll 320 and providing a space for guiding the refrigerant to the discharger 121.

The muffler may be constructed to seal one face disposed in a direction farther away from the discharger 121 of the fixed scroll 320 to guide the refrigerant discharged from the fixed scroll 320 to the discharger 121.

The muffler may include a coupling body coupled to the fixed scroll 320 and a receiving body 510 extending from the coupling body to define sealed space therein. Thus, the refrigerant sprayed from the discharge hole 326 may be discharged to the discharger 121 by switching the flow direction along the sealed space defined by the muffler.

Further, since the fixed scroll 320 is coupled to the receiving shell 110, the refrigerant may be restricted from flowing to the discharger 121 by being interrupted by the fixed scroll 320. Therefore, the fixed scroll 320 may further include the bypass hole 327 passing through the fixed end plate 321 to allow the refrigerant to pass through the fixed scroll 320. The bypass hole 327 may be constructed to be in communication with the main hole 317. Thus, the refrigerant may pass through the compression assembly 300, pass by the driver 200, and be discharged to the discharger 121.

Further, as the refrigerant flows more inwardly from an outer circumferential face of the fixed wrap 323, the refrigerant is compressed to have a higher pressure. Thus, an interior of the fixed wrap 323 and an interior of the orbiting wrap 333 is maintained in a high pressure state. Accordingly, a discharge pressure is exerted to a rear face of the orbiting scroll as it is. Thus, in a reaction manner thereto, the backpressure is exerted from the orbiting scroll 330 toward the fixed scroll 320. The compressor 10 according to one embodiment of the present disclosure may further include a backpressure seal 350 that concentrates the backpressure on a portion where the orbiting scroll 320 and the rotatable shaft 230 are coupled to each other, thereby preventing leakage between the orbiting wrap 333 and the fixed wrap 323.

The backpressure seal 350 has a ring shape to maintain an inner circumferential face thereof at a high pressure, and separate an outer circumferential face thereof at an intermediate pressure lower than the high pressure. Therefore, the backpressure is concentrated on the inner circumferential face of the backpressure seal 350, so that the orbiting scroll 330 is in close contact with the fixed scroll 320.

In this connection, when considering that the discharge hole 326 is defined to be spaced apart from the rotatable shaft 230, the backpressure seal 350 may be configured such that a center thereof is biased toward the discharge hole 326. In addition, due to the backpressure seal 350, the oil supplied from the first oil feed groove 234*a* may be supplied to the inner circumferential face of the backpressure seal 350. Therefore, the oil may lubricate a contact face between the main scroll and the orbiting scroll. Further, the oil supplied to the inner circumferential face of the backpressure seal 350 may generate a backpressure for pushing the orbiting scroll 330 to the fixed scroll 320 together with a portion of the refrigerant.

As such, the compression space of the fixed wrap 323 and the orbiting wrap 333 may be divided into the high pressure region S1 inside the backpressure seal 350 and the intermediate pressure region V1 outside the backpressure seal 350 on the basis of the backpressure seal 350. In one example, the high pressure region S1 and the intermediate pressure region V1 may be naturally divided because the pressure is increased in a process in which the refrigerant is inflowed and compressed. However, since the pressure change may occur critically due to a presence of the backpressure seal 350, the compression space may be divided by the backpressure seal 350.

In one example, the oil supplied to the compression assembly 300, or the oil stored in the casing 100 may flow toward an upper portion of the casing 100 together with the refrigerant as the refrigerant is discharged to the discharger 121. In this connection, because the oil is denser than the refrigerant, the oil may not be able to flow to the discharger 121 by a centrifugal force generated by the rotor 220, and may be attached to inner walls of the discharge shell 110 and the receiving shell 120. The lower scroll type compressor 10 may further include collection channels respectively on outer circumferential faces of the driver 200 and the compression assembly 300 to collect the oil attached to an inner wall of the casing 100 to the oil storage space of the casing 100 or the sealing shell 130.

The collection channel may include a driver collection channel 201 defined in an outer circumferential face of the driver 200, a compressor collection channel 301 defined in an outer circumferential face of the compression assembly 300, and a muffler collection channel defined in an outer circumferential face of the muffler.

The driver collection channel 201 may be defined by recessing a portion of an outer circumferential face of the stator 210 is recessed, and the compressor collection channel 301 may be defined by recessing a portion of an outer circumferential face of the fixed scroll 320. In addition, the muffler collection channel may be defined by recessing a portion of the outer circumferential face of the muffler. The driver collection channel 201, the compressor collection channel 301, and the muffler collection channel may be defined in communication with each other to allow the oil to pass therethrough.

As described above, because the rotation shaft 230 has a center of gravity biased to one side due to the eccentric shaft 232*b*, during the rotation, an unbalanced eccentric moment occurs, causing an overall balance to be distorted. Accordingly, the lower scroll type compressor 10 according to the present disclosure may further include a balancer 400 that may offset the eccentric moment that may occur due to the eccentric shaft 232*b*.

Because the compression assembly 300 is fixed to the casing 100, the balancer 400 is preferably coupled to the rotation shaft 230 itself or the rotor 220 constructed to rotate. Therefore, the balancer 400 may include a central balancer 410 disposed on a bottom of the rotor 220 or on a face facing the compression assembly 300 to cancel or reduce an eccentric load of the eccentric shaft 232*b*, and an outer balancer 420 coupled to a top of the rotor 220 or the other face facing the discharger 121 to offset an eccentric load or an eccentric moment of at least one of the eccentric shaft 232*b* and the outer balancer 420.

Because the central balancer 410 is disposed relatively close to the eccentric shaft 232*b*, the central balancer 410 may directly offset the eccentric load of the eccentric shaft 232*b*. Accordingly, the central balancer 410 is preferably disposed eccentrically in a direction opposite to the direction in which the eccentric shaft 232*b* is eccentric. As a result, even when the rotation shaft 230 rotates at a low speed or a high speed, because a spacing away from the eccentric shaft 232*b* is close, the central balancer 410 may effectively offset an eccentric force or the eccentric load generated in the eccentric shaft 232*b* almost uniformly.

The outer balancer 420 may be disposed eccentrically in a direction opposite to the direction in which the eccentric shaft 232*b* is eccentric. However, the outer balancer 420 may be eccentrically disposed in a direction corresponding to the eccentric shaft 232*b* to partially offset the eccentric load generated by the central balancer 410.

As a result, the central balancer 410 and the outer balancer 420 may offset the eccentric moment generated by the eccentric shaft 232*b* to assist the rotation shaft 230 to rotate stably.

Figure 3A:
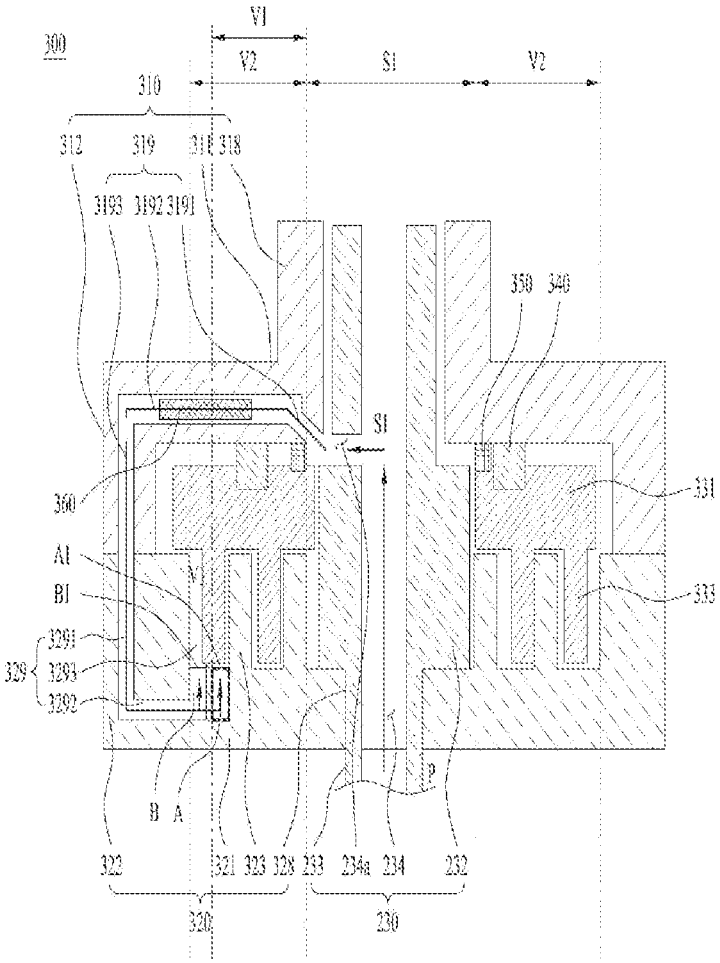
FIGS. 3A and 3B show an embodiment of an oil feeding structure applied to a compressing assembly of the compressor according to the present disclosure.
Figure 3B:
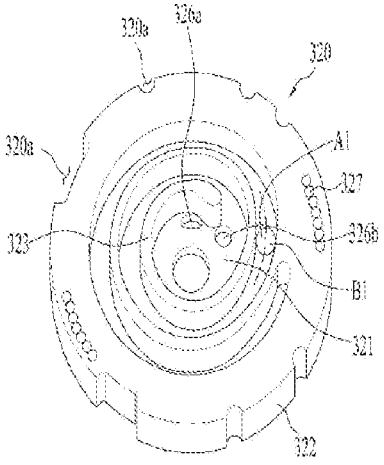

FIGS. 3A and 3B show the compressing assembly and an oil feeding structure of the compressor according to the present disclosure.

FIG. 3A shows a cross section of the compressing assembly, and FIG. 3B shows the fixed wrap 323 of the fixed scroll 320.

The compressing assembly 300 according to the present disclosure may include an oil feeding channel which passes through the orbiting end plate 331 and the fixed end plate 321 and delivers the oil delivered from the oil supply channel 234 of the rotatable shaft 230 to the compression chamber defined between the orbiting wrap 333 and the fixed wrap 322.

The oil feeding channel may include a plurality of oil feeding channels. All of the plurality of oil feeding channels may not be closed by the orbiting wrap 333 or the fixed wrap 323 when the orbiting scroll 330 orbits around the fixed scroll 320.

For example, the oil feeding channel may include a first oil channel A constructed to supply oil to a region between the fixed wrap 323 and the orbiting wrap 333, and a second oil channel B separated from the first oil channel A or branched from the first oil channel A and constructed to supply oil to a region different from the region to which the first oil channel supplies the oil.

Accordingly, the compressor 10 according to the present disclosure may supply oil to the compressing assembly 300 through the plurality of oil channels such as the first oil channel A and the second oil channel B. Therefore, it is possible to quickly and evenly supply the oil to the entire region of the compressing assembly 300.

A spacing between an outlet A1 (e.g., "first outlet") of the first oil channel and the rotatable shaft 230 may be smaller than a spacing between an outlet B1 (e.g., "second outlet") of the second oil channel and the rotatable shaft 230.

In the compressing assembly 300 according to the present disclosure, a region which corresponds to the inside of the backpressure seal 350, and in which the discharge hole 326 is placed may be defined as a high pressure region S1. An intermediate pressure region V1 is outside the high pressure region S1 and has a pressure higher than the pressure of the incoming refrigerant. A region which is farther away from the rotatable shaft than the intermediate pressure region V1 is and is adjacent to the inlet of the refrigerant may be defined as a lower pressure region V2. For example, the lower pressure region V2 may refer to a region where the fixed wrap 323 starts to be wound by a half around the rotatable shaft 230 (about 0 to 180 degrees).

The outlet A1 of the first oil channel may be disposed in the intermediate pressure region V1, and the outlet B1 of the second oil channel may be disposed in the lower pressure region V2. Accordingly, the first oil channel A may preferentially supply oil to the high pressure region S1 faster than the second oil channel B may. The second oil channel B may preferentially supply oil to the lower pressure region V2 faster than the first oil channel A may. Therefore, whether the compressor 300 compresses the refrigerant at high pressure or at a lower pressure, oil may be smoothly supplied through the first oil channel A and the second oil channel B.

In particular, the second oil channel B may be located outside the first oil channel A, or the outlet B1 of the second oil channel may be located closer to the refrigerant inlet than the outlet A1 of the first oil channel may. Thus, the second oil channel B may more effectively supply oil to the lower pressure region V2 than the first oil channel A may. That is, the second oil channel B may generate a greater differential pressure from that of the oil supply channel 234 than the first oil channel A may, so that oil may be more effectively supplied to the lower pressure region V2.

In one example, when the compressor 300 operates at lower pressure, the differential pressure between the lower pressure region V2 and the high pressure region S1 is not sufficiently large, such that it is difficult to supply oil from the oil supply channel 234. Thus, the outlet A1 of the first oil channel and the outlet B1 of the second oil channel may not be placed in the high pressure region S1, but the outlet A1 of the first oil channel and the outlet B1 of the second oil channel may be placed in the intermediate pressure region V1, or one of the outlet A1 of the first oil channel and the outlet B1 of the second oil channel may be placed in the lower pressure region V2.

As the eccentric shaft 232*c* rotates, the orbiting wrap 333 may reciprocate toward or away from the fixed wrap 323 facing the orbiting wrap 333. In this process, the outlet of the oil feeding channel I may be closed by the orbiting wrap 333. To prevent this blockage, the outlet A1 of the first oil channel and the outlet B2 of the second oil channel may be spaced apart from each other by a spacing sized such that both of the outlet A1 of the first oil channel and the outlet B2 of the second oil channel may be prevented from being blocked by the orbiting wrap 333 or the fixed wrap 322.

For example, the outlet A1 of the first oil channel and the outlet B1 of the second oil channel may be spaced from each other by a spacing larger than a spacing sized such that the outlet A1 of the first oil channel and the outlet B1 of the second oil channel may be selectively closed by the orbiting wrap 333 or the fixed wrap 323.

When the orbiting wrap 333 closes the outlet A1 of the first oil channel, the outlet B1 of the second oil channel is spaced apart from the orbiting wrap 333, and is in an open state so that the oil may be supplied through the open the outlet B1. Further, when the orbiting wrap 333 closes the outlet B1 of the second oil channel, the outlet A1 of the first oil channel is spaced apart from the orbiting wrap 333, and is in an open state so that the oil may be supplied through the open the outlet A1.

In another example, it is desirable that the outlet A1 of the first oil channel and the outlet B1 of the second oil channel are always open, and are not closed by the orbiting wrap 333 or the fixed wrap 323. When the outlet A1 of the first oil channel and the outlet B1 of the second oil channel are not defined in the orbiting wrap 333 or the fixed wrap 323, both must be blocked by the orbiting wrap 333 or the fixed wrap 323. In particular, each of diameters of the outlet A1 of the first oil channel and the outlet B1 of the second oil channel is generally smaller than a thickness of the fixed wrap 323 or the orbiting wrap 333 in order not to discharge excessive oil. Therefore, at least one of the outlet A1 of the first oil channel and the outlet B1 of the second oil channel is sealed by the orbiting wrap 333 or the fixed wrap 323.

Therefore, the outlet A1 of the first oil channel and the outlet B1 of the second oil channel are spaced from each other by a spacing S larger than the thickness of the orbiting wrap 333 or the fixed wrap 323, such that both of the outlet A1 of the first oil channel and the outlet B1 of the second oil channel may be prevented from being closed by the orbiting wrap 333 or the fixed wrap 323.

In one example, both of the outlet A1 of the first oil channel and the outlet B1 of the second oil channel may be placed in the intermediate pressure region V1 or in the lower pressure region V2. Further, the outlet A1 of the first oil channel and the outlet B1 of the second oil channel may be disposed adjacent to each other, but may be disposed at completely different angular positions around the rotatable shaft 230.

In this case, one of the outlet A1 of the first oil channel and the outlet B1 of the second oil channel may supply oil to an inner channel formed by an outer face of the orbiting wrap 333 and an inner face of the fixed wrap 323, while the remaining one of the outlet A1 of the first oil channel and the outlet B1 of the second oil channel may supply oil to an outer channel formed by an inner face of the orbiting wrap 333 and an outer face of the fixed wrap 323.

As a result, even when the outlet A1 of the first oil channel and the outlet B1 of the second oil channel are arranged at completely different angular positions around the rotatable shaft 230, or are spaced by different distances from the rotatable shaft 230, both of the outlet A1 of the first oil channel and the outlet B1 of the second oil channel may be prevented from being closed by the orbiting wrap 323 or the fixed wrap 333. In other words, at least one of the outlet A1 of the first oil channel and the outlet B1 of the second oil channel may be kept open.

Referring to FIG. 3B, the outlet A1 of the first oil channel may be placed in the outer channel formed by the outer face of the fixed wrap 323 and the inner face of the orbiting wrap 333, while the outlet B1 of the second oil channel may be disposed in an inner channel formed by the inner face of the fixed wrap 323 and the outer face of the orbiting wrap 333.

Further, the outlet A1 of the first oil channel and the outlet B1 of the second oil channel may be spaced apart from each other by a spacing larger than the thickness of the orbiting wrap 333.

Thus, when the orbiting wrap 333 is placed on the outer channel while the orbiting wrap 333 is orbiting, the second oil channel B supplies oil to the compression chamber. When the orbiting wrap 333 is placed on the inner channel while the orbiting wrap 333 is orbiting, the first oil channel A may supply oil to the compression chamber. As a result, no matter where the orbiting wrap 333 is located inside the fixed scroll 320, oil may be continuously supplied to the compression chamber 300, and the oil may be evenly supplied to the compression chamber.

Hereinafter, an embodiment in which the first oil channel A and the second oil channel B may be specifically installed in the compressing assembly 300 will be described.

The first oil channel A and the second oil channel B may pass through one of the fixed scroll 320 or the orbiting scroll 330.

Referring to FIGS. 3A and 3B, the first oil channel A and the second oil channel B may pass through the fixed scroll 320, and the main frame 310.

In this connection, the first oil channel A and the second oil channel B may be disposed in a position where both of the first oil channel A and the second oil channel B are not closed by the orbiting wrap 333.

The oil feeding channel I may include an oil transfer channel 319 passing through the main frame 310 and a fixed oil channel 329 passing through the fixed scroll 320. Therefore, the first oil channel A and the second oil channel B may share the oil transfer channel 319 and the fixed oil channel 329, whereas the outlet A1 of the first oil channel and the outlet B1 of the second oil channel may be placed in different locations. As a result, the process of installing the oil channel on the main frame 310 and the fixed scroll 320 may be simplified.

The oil feeding channel I may include the oil transfer channel 319 which is defined in the main frame 310, and along which the oil supplied from the oil supply channel 234 flows, and the fixed oil channel 329 defined in the fixed scroll and constructed to communicate with the oil transfer channel to supply the oil to a region between the orbiting scroll 330 and the fixed scroll 310.

In the compressing assembly 300 of the compressor according to the present disclosure, the oil transfer channel 319 may be defined in the main frame 310 fixed to the casing 100, and thus the position thereof may always be fixed. Therefore, the oil may be stably introduced into the oil transfer channel 319 and may be stably transferred to the fixed oil channel 329. Further, the amount of oil supplied through the oil transfer channel 319 may be more easily controlled.

The oil transfer channel 319 may include a main oil channel 3191 passing through the main shaft receiving portion 318 and receiving the oil, an oil passage channel 3192 which extends from the main oil channel 3191 to the outer circumferential face along the main end plate 311 and through which the oil passes, and an oil discharge channel 3193 connected to a distal end of the oil passage channel 3192 and extending toward the fixed frame 320 to discharge the oil.

The main oil channel 3191 may be defined separately from a space between the main end plate 311 of the main frame and the orbiting end plate 331 of the orbiting scroll. As a result, the oil discharged from the first oil feeding hole 241*a* may flow in a region between the main end plate 311 and the orbiting end plate 331 and may be supplied to the backpressure seal 350, and at the same time may flow into the main oil channel 3191.

The main frame 310 is always fixed to the casing 100. Thus, when the oil transfer channel 319 is defined in the main frame 310, oil may be stably supplied to the fixed scroll 320.

In one example, the fixed oil channel 329 may include an oil inflow channel 3291 which is defined in the fixed side plate to communicate with the oil discharge channel 3193, and into which the oil supplied to the oil transfer channel flows, and an oil flow channel 3292 constructed to communicate with the oil inflow channel 3291 and defined in the fixed end plate to move the oil supplied to the oil inflow channel to the fixed wrap 332.

In this connection, the fixed oil channel 329 must supply the oil to at least the outer circumferential face of the fixed wrap 323. Thus, the oil inflow channel 3291 may extend from the fixed side plate so as to have a length larger than or equal to the thickness of the fixed wrap 323. Further, the oil flow channel 3292 may extend from the oil inflow channel 3291 to the outermost inner peripheral face of the fixed wrap 323.

In one example, when the oil inflow channel 3291 extends in a longer manner than the thickness of the fixed wrap 323, the fixed oil channel 329 may further include a lubrication oil channel 3293 extending from the oil flow channel 3292 to an inner face of the fixed end plate 323 or a portion in direct communication to the fixed wrap 323.

The oil inflow channel 3291 and the lubrication oil channel 3293 may extend in a parallel manner to each other. The oil flow channel 3292 may extend at a right angle or in an inclined manner with respect to the oil inflow channel and the lubrication oil channel.

In one example, the backpressure seal 350 may be installed inside the Oldham ring 350, and may be constructed to prevent an entirety of the oil supplied from the rotatable shaft 230 from leaking out directly into a region between the main frame 310 and the orbiting scroll 330. The backpressure seal 350 may play a role of guiding the oil introduced from the rotatable shaft 230 to be transferred to the main oil channel 3191.

In one example, when the orbiting scroll 330 is orbiting at high speed, the pressure difference between the high pressure region S1 and the intermediate pressure region V1 may be very large, thereby causing excessive oil supply to the fixed wrap 323 and orbiting wrap 333. Thus, a large amount of oil may be input into the incoming refrigerant, the fixed wrap 323 and the orbiting wrap 333 may be cooled due to the oil, or the oil feeding to the fixed wrap 323 may be stopped.

To prevent this problem, the compressor of one embodiment of the present disclosure may include pressure reducing means 360 disposed in the oil transfer channel 319 or the fixed oil channel 329 and capable of reducing the pressure difference between the high pressure region and the lower pressure region. The pressure reducing means 360 may be inserted into the oil transfer channel or the fixed oil channel to reduce the diameter of the oil channel to increase the oil channel resistance. Further, the pressure reducing means 360 may maximize friction with the oil to increase the oil channel resistance. Therefore, due to the pressure reducing means 360, the pressure difference between the high pressure region S1 and the intermediate pressure region V1 may be partially compensated for to prevent the excessive oil from being supplied to the fixed wrap 323 and the orbiting wrap 333.

Since the pressure reducing means 360 must be installed and inserted into the oil transfer channel or the fixed oil channel, the main frame 310 or the fixed scroll 320 may further include a receiving hole constructed to receive the pressure reducing means 360 and communicate with the outside of the compressing assembly 300.

In one example, the oil inflow channel 3291 is defined in the fixed frame 320 for excellent durability, and acts as a location where oil flows into the intermediate pressure region V1 defined in the fixed frame 320. Therefore, unlike shown, the pressure reducing means 360 may be inserted into the oil inflow channel 3291. As a result, stability of the pressure reducing means 360 against external shocks and vibrations may be ensured, and the pressure reducing means 360 may most immediately control the amount of oil to be supplied to the intermediate pressure region V1.

The lubrication oil channel 3293 may include a first lubrication oil channel 3293A communicating with the outlet A1 of the first oil channel, and a second lubrication oil channel 3293B communicating with the outlet B1 of the second oil channel.

That is, the first oil channel A and the second oil channel B may be constructed to share the oil transfer channel 319, and the oil inflow channel 3291 and the oil flow channel 3292 of the fixed oil channel 329 with each other.

In this connection, the second lubrication oil channel 3293B may be first branched from the oil flow channel 3292 and extend toward the fixed wrap 323, and the first lubrication oil channel 3293A may extend from the oil flow channel 3292 to the rotatable shaft 230 and extend towards the fixed wrap 323.

For example, the second lubrication oil channel 3293B may be in communication with the outermost face of the fixed wrap 323. The outermost face of the fixed wrap 323 may refer to a portion at which the fixed wrap begins to engage with the orbiting wrap 333. Thus, the second lubrication oil channel 3293B may supply oil more smoothly to the lower pressure region V2.

Thus, the main oil channel 3191 acing as the inlet of the oil transfer channel 319 may be located in the high pressure region S1, and the fixed oil channel 329 may be located in the intermediate pressure region V1. Thus, due to the pressure difference therebetween, as the oil supplied from the first oil feeding hole 234*a* flows into the oil transfer channel 319, the oil may be transferred to the fixed oil channel 329. Thus, the oil may be delivered to the fixed wrap 323 and lubricate the orbiting wrap 333 and the fixed wrap 323.

In one example, the compressor 10 according to the present disclosure rotates the rotatable shaft 230 at high speed to discharge the refrigerant at high pressure from the compressing assembly 300. However, the compressor 10 according to the present disclosure rotates the rotatable shaft 230 at a low speed to discharge the refrigerant at a relatively lower pressure from the compressing assembly 300.

When the refrigerant is compressed at the lower pressure in the compressing assembly 300 and is discharged out thereof, the coefficient of performance of the refrigeration cycle may be increased, and noise and vibration may be reduced. However, the differential pressure between the high pressure region S1 near the rotatable shaft 230 and the intermediate pressure region V1 near the fixed side plate 322 may be reduced accordingly.

Therefore, the differential pressure between the high pressure region S1 and the intermediate pressure region V1 is not large, such that the oil supplied from the rotatable shaft 230 may not be supplied smoothly from the oil transfer channel 319 or the fixed oil channel 329, the oil supply may be stopped, or the oil may reversely flow. Further, due to the pressure reducing means 360, the differential pressure between the intermediate pressure region V1 and the high pressure region S1 may be further reduced, thereby making it more difficult to supply the oil to the first oil channel A or causing the oil backward flow.

However, due to the arrangement of the second oil channel B, the oil may be smoothly supplied to the lower pressure region V2. Therefore, regardless of what load the compressor 10 operates under, the oil may be supplied to the inside of the compressing assembly 300 regardless of the pressure situation.

Further, the first oil channel A may be disposed in an outer channel formed by the outer face of the fixed wrap 323 and the inner face of the orbiting wrap 333, while the second oil channel B may be disposed in an inner channel formed by the inner face of the fixed wrap 323 and the outer face of the orbiting wrap 323.

Further, the outlet A1 of the first oil channel and the outlet B1 of the second oil channel may be spaced from each other by a spacing larger than the thickness of the orbiting wrap 333. As a result, at least one of the outlet A1 of the first oil channel and the outlet B1 of the second oil channel may be kept open regardless of the position of the orbiting wrap 333, thereby preventing the situation that the oil feeding to the compressing assembly 300 is stopped.

Figure 4:
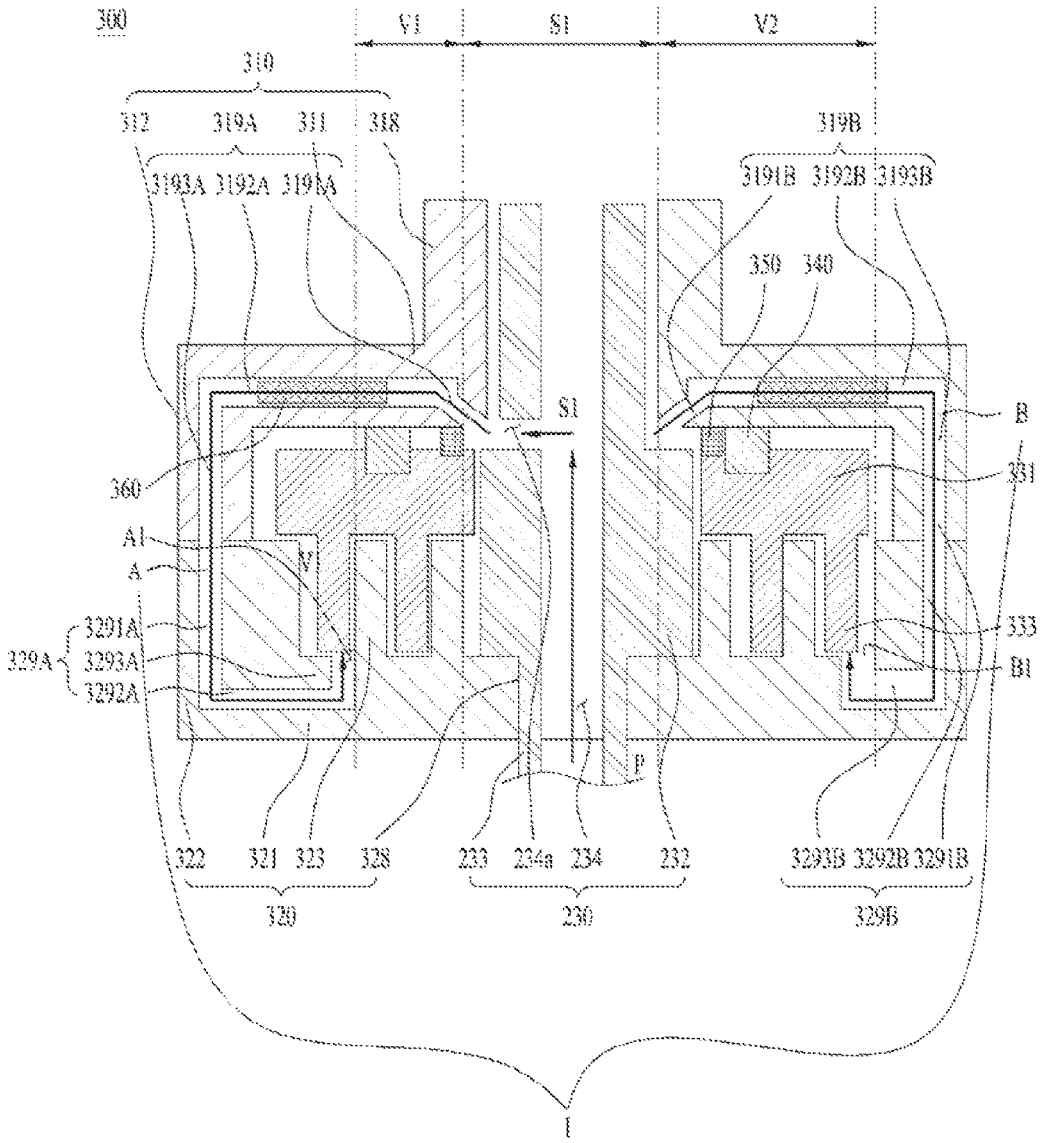
FIG. 4 shows an embodiment in which the oil feeding structure of FIGS. 3A and 3B may be implemented.

FIG. 4 shows an embodiment in which a compressor according to the present disclosure has a plurality of oil feeding channels. Hereinafter, in order to avoid overlapping descriptions, the description will focus on differences from the embodiment of FIGS. 3A and 3B.

As shown in FIGS. 3A and 3B, when the first oil channel A and the second oil channel B share most of the oil channels, there is a concern that sufficient oil may not be supplied to the outlet A1 of the first oil channel and the outlet B1 of the second oil channel.

Accordingly, the compressor 10 according to the present disclosure may have the first oil channel A and the second oil channel B as independent oil channels. As a result, oil may be introduced and discharged into and from the first oil channel A and the second oil channel B, individually, so that sufficient oil may be continuously supplied to the compression chamber 300.

The first oil channel A may include a first oil transfer channel 319A defined in the main frame 310 to move the oil supplied from the rotatable shaft, and a first fixed oil channel 329A defined in the fixed end plate 321 to communicate with the first oil transfer channel 319A and defined at a distal end of the outlet A1 of the first oil channel.

The first oil transfer channel 319A may include a first main oil channel 3191A passing through the main shaft receiving portion 318 to receive oil, a first oil passage channel 3192A which extends from the first main oil channel 3191A toward the outer circumferential face along the main end plate 311 and through which the oil passes, and a first oil discharge channel 3193A connected to the distal end of the first oil passage channel 3192A and extending toward the fixed frame 320 to discharge the oil.

The first fixed oil channel 329A may include a first oil inflow channel 3291A defined inside the fixed side plate to communicate with the first oil discharge channel 3193A to receive the oil supplied to the first oil transfer channel, a first oil flow channel 3292A constructed to communicate with the first oil inflow channel 3291A and defined inside the fixed end plate to move the oil supplied from the first oil inflow channel 3291A to the fixed wrap 332, and a first lubrication oil channel 3292A extending from the first oil flow channel to the outlet A1 of the first oil channel.

The second oil channel may include a second oil transfer channel 329B which is defined in the main frame 310 and is spaced apart from the first oil transfer channel 319A, and, along which the oil supplied from the rotatable shaft moves, and a second fixed oil channel 329B defined in the fixed end plate and constructed to communicate with the second oil transfer channel 329B and defined at the distal end of the outlet B1 of the second oil channel.

The second oil transfer channel 319B may include a second main oil channel 3191B passing through the main shaft receiving portion 318 and receiving oil, a second oil passage channel 3192B which extends from the second main oil channel 3191B toward the outer circumferential face along the main end plate 311 and through which the oil passes, and a second oil discharge channel 3193B connected to the distal end of the second oil passage channel 3192B and extending toward the fixed frame 320 to discharge the oil.

The second fixed oil channel 329B may include a second oil inflow channel 3291B which is defined inside the fixed side plate to communicate with the second oil discharge channel 3193B, and into which oil supplied to the second oil transfer channel flows, a second oil flow channel 3292B which is constructed to communicate with the second oil inflow channel 3291B and defined inside the fixed end plate and moves the oil supplied to the second oil inflow channel 3291B to the fixed wrap 332, and a second lubrication oil channel 3292B extending from the second oil flow channel to the outlet B1 of the second oil channel.

The first oil channel A and the second oil channel B may have similar shapes. However, the outlet A1 of the first oil channel may be closer to the discharge hole 326 than the outlet B1 of the second oil channel may, and may be closer to the inner face of the orbiting wrap 333 than the outlet B1 of the second oil channel may.

Accordingly, the outlet A1 of the first oil channel rather than the outlet B1 of the second oil channel smoothly supplies oil to the lower pressure region. Both of the outlet A1 of the first oil channel and the outlet B1 of the second oil channel may be prevented from being closed by the orbiting wrap 333 at the same time.

Further, the first oil channel A may be disposed in an outer channel formed by the outer face of the fixed wrap 323 and the inner face of the orbiting wrap 333, while the second oil channel B may be disposed in an inner channel formed by the inner face of the fixed wrap 323 and the outer face of the orbiting wrap 323.

Further, the outlet A1 of the first oil channel and the outlet B1 of the second oil channel may be spaced from each other by a spacing larger than the thickness of the orbiting wrap 333. As a result, at least one of the outlet A1 of the first oil channel and the outlet B1 of the second oil channel may be kept open regardless of the position of the orbiting wrap 333, thereby preventing the situation that the oil feeding to the compressing assembly 300 is stopped.

Figure 5A:
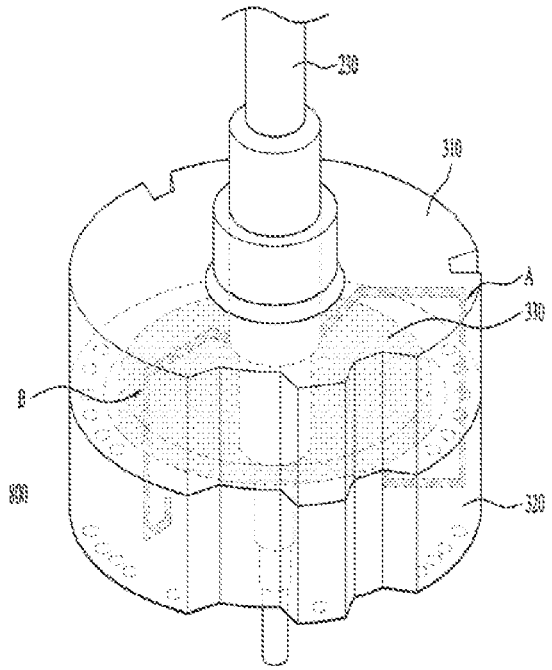
FIGS. 5A and 5B show an embodiment in which the oil feeding structure of FIG. 4 is implemented in the compressing assembly.
Figure 5B:
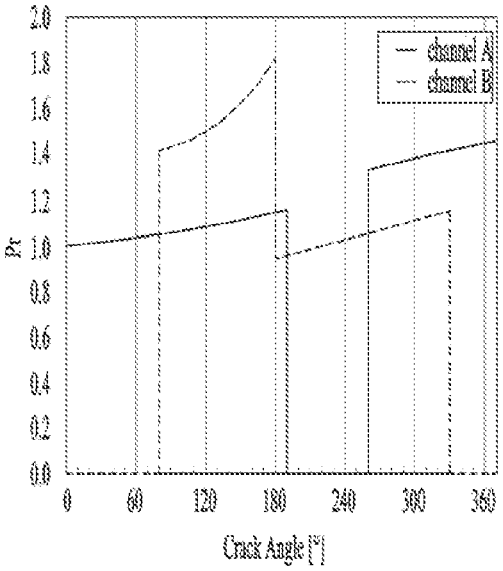

FIGS. 5A and 5B show a structure to which the oil feeding channel of FIG. 4 is applied.

Referring to FIG. 5A, the compressor 10 according to the present disclosure includes a first oil channel A defined in at least one of the orbiting scroll 320 or the main frame 310, and in the fixed scroll 320 to feed the oil supplied from the rotatable shaft to a region between the orbiting scroll and the fixed scroll, and a second oil channel B defined in at least one of the orbiting scroll 330 or the main frame 310, and defined in the fixed scroll 320 and spaced from the first oil channel A to feed the oil supplied from the rotatable shaft 230 to a region between the orbiting scroll 330 and the fixed scroll 310.

When the first oil channel A is constructed to communicate with the intermediate pressure region V1, and the second oil channel B is constructed to communicate with the lower pressure region V2, the oil supplied through the oil feeding hole 234 may be supplied to the intermediate pressure region V1 through the first oil channel A, and may be supplied to the lower pressure region V2 through the second oil channel B. In other words, the compressor 10 according to the present disclosure has the first oil channel A that supplies oil to the intermediate pressure region V1 for a high pressure ratio operation, and the second oil channel B which supplies oil to the lower pressure region V2 for a lower pressure ratio operation.

When the first oil channel A and the second oil channel B are both installed in the intermediate pressure region V1 or the lower pressure region V2 at the same time, the first oil channel A may be placed in the outer channel formed by the inner face of the orbiting wrap 333 and the outer face of the fixed wrap 323, while the second oil channel B may be disposed in an inner channel formed by an outer face of the orbiting wrap 333 and an inner face of the fixed wrap 323.

Accordingly, the first oil channel A and the second oil channel B may supply oil to different oil channels, respectively, and both thereof may be prevented from being closed by the orbiting wrap 333 or the fixed wrap 323.

Referring to FIG. 5B, the compressor 10 according to the present disclosure may have a region to which the oil feedings through the first oil channel A and the second oil channel B are simultaneously performed. Furthermore, in an angle range of 190° to 270° in which oil feeding through the first oil channel A is blocked, the oil feeding may be continued through the second oil channel B. Further, in an angle range of 0 to 80 degrees, and 270 degrees to 360 degrees in which oil feeding through the second oil channel B is blocked, the oil feeding may continue through the first oil channel A.

As a result, the oil feeding to the compressing assembly 300 may be fundamentally activated at all times.

Figure 6:
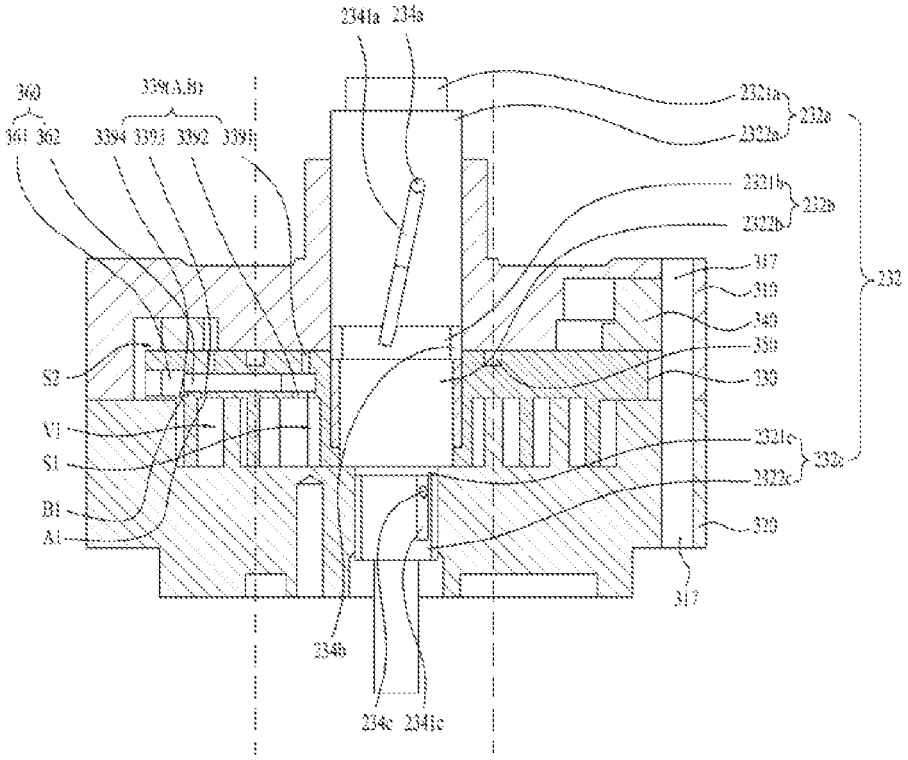
FIG. 6 shows another embodiment of an oil feeding structure applied to the compressing assembly of the compressor according to the present disclosure.

FIG. 6 shows another oil feeding channel structure of the compressor according to the present disclosure.

The oil feeding channel according to the present disclosure may be defined in the orbiting scroll 330. That is, the process of installing the oil feeding channel in the fixed scroll 320 may be omitted.

That is, the outlet A1 of the first oil channel and the outlet B1 of the second oil channel may be defined in the orbiting end plate 331.

Specifically, the oil feeding channel may include an orbiting oil channel 339 passing through the orbiting scroll 330. The orbiting oil channel 339 may include an orbiting oil input channel 3391 through which the oil delivered from the first oil feeding hole 234*a* or the first oil feeding groove 2341*a* is injected into the orbiting scroll, a connection oil channel 3392 extending from the orbiting oil input channel toward the outer circumferential face of the orbiting scroll, a branched oil channel 3393 branching from the connection oil channel 3392 toward the fixed scroll 320 and defining the outlet B1 of the second oil channel, and a communication oil channel 3394 that is spaced from the connection oil channel 3392 toward the outer circumferential face of the orbiting end plate 331 by a spacing larger than a spacing by which the second oil channel is spaced from the connection oil channel 3392, thereby to form the outlet A1 of the first oil channel.

That is, the first oil channel A and the second oil channel B may share the orbiting oil input channel 3391 and the connection oil channel 3392. As a result, the oil delivered through the rotatable shaft 230 may be directly supplied to the orbiting wrap 333 and the fixed wrap 323 through the orbiting scroll 330.

In one example, since the pressure difference between the intermediate pressure region V1 and the high pressure region S1 is large, oil may be excessively supplied from the rotatable shaft 230. Therefore, there may be a problem that a sufficient amount of the refrigerant may not be compressed or the compressing assembly 300 is excessively cooled. To prevent this problem, the scroll type compressor 300 may include the pressure reducing means 360 which is inserted into the oil transfer channel 330 to adjust the supply amount of oil. The pressure reducing means 360 reduced the cross-sectional area of the oil transfer channel 330 to generate the oil channel resistance to prevent excessive oil from being supplied.

As shown, the orbiting wrap 333 may be disposed between the outlet A1 of the first oil channel and the outlet B1 of the second oil channel. Between adjacent orbiting wraps 333, the outlet A1 of the first oil channel and the outlet B1 of the second oil channel may be disposed.

Further, the outlet A1 of the first oil channel may be closer to the outer face of the orbiting wrap 333, while the outlet B1 of the second oil channel may be closer to the inner face of the orbiting wrap. That is, the outlet A1 of the first oil channel and the outlet B1 of the second oil channel may be closer to a first orbiting wrap 333 disposed between the outlet A1 of the first oil channel and the outlet B1 of the second oil channel than to a second orbiting wrap 333 adjacent to the first orbiting wrap 333.

Accordingly, the outlet A1 of the first oil channel and the outlet B1 of the second oil channel may supply oil to the inner and outer faces of the orbiting wrap 333, respectively.

That is, the first oil channel A may be disposed in an outer channel formed by the outer face of the fixed wrap 323 and the inner face of the orbiting wrap 333, and the second oil channel B may be disposed in an inner channel formed by the inner face of the fixed wrap 323 and the outer face of the orbiting wrap 323.

Further, the outlet A1 of the first oil channel and the outlet B1 of the second oil channel may be spaced apart from each other by a spacing larger than the thickness of the fixed wrap 323.

As a result, when the outlet A1 of the first oil channel is closed by the fixed wrap 323, the outlet B1 of the second oil channel may be spaced apart from the fixed wrap 323 and may be opened. When the outlet B1 of the second oil channel is closed by the fixed wrap 323, the outlet A1 of the first oil channel may be spaced apart from the fixed wrap 323 and may be opened.

Therefore, at least one of the outlet A1 of the first oil channel and the outlet B1 of the second oil channel may be kept open regardless of the position of the fixed wrap 323, and oil feeding to the compressing assembly 300 is prevented from being stopped.

In one example, unlike shown, both of the branched oil channel 3393 and the communication oil channel 3394 may be disposed between a specific orbiting wrap 333 and an orbiting wrap 333 adjacent thereto. That is, both of the outlet A1 of the first oil channel and the outlet B1 of the second oil channel may be disposed between the outer orbiting wrap 333 and the inner orbiting wrap 333. An orbiting wrap 333 may not be formed between the outlet A1 of the first oil channel and the outlet B1 of the second oil channel, and a fixed wrap 323 may be selectively disposed therebetween.

Even in this case, the outlet A1 of the first oil channel may be disposed adjacent to the inner face of the orbiting wrap 333, and the outlet B1 of the second oil channel may be defined adjacent to the outer face of the orbiting wrap 333. Therefore, the first oil channel A may supply oil to the outer channel, and the second oil channel B may supply oil to the inner channel. As the orbiting scroll 330 is orbiting, one of the inner channel and the outer channel invades the fixed wrap 323, but the other thereof may be spaced from the fixed wrap 323.

As a result, oil feeding into a region between the orbiting scroll 330 and the fixed scroll 320 may be continued without interruption.

In another example, unlike shown in FIG. 6, even when the oil feeding channel is installed in the orbiting end plate 331, the first oil channel A and the second oil channel B may be arranged independently of each other.

That is, the first oil channel A may include a first orbiting oil input channel 3391 which passes through the orbiting end plate and through which oil is input to the orbiting scroll, a first connection oil channel 3392 extending from the first orbiting oil input channel toward the outer circumferential face of the orbiting scroll, and a branched oil channel 3393 passing through the orbiting end plate and communicating the connection oil channel and the outlet A1 of the first oil channel.

The second oil channel may include a second orbiting oil input channel 3391B which is spaced apart from the first orbiting oil input channel and passes through the orbiting end plate, and through which oil is introduced into the orbiting scroll, a second connection oil channel 3392B extending from the second orbiting oil input channel toward the outer circumferential face of the orbiting scroll, and a communication oil channel 3394 passing through the orbiting end plate and communicating the second connection oil channel 3392B with the outlet B1 of the second oil channel.

That is, unlike shown, the first oil channel A and the second oil channel B may be independently defined. The first oil channel A may independently supply oil to the inner channel, and the second oil channel B may independently feed the oil to the outer channel.

As a result, even in a state of the lower pressure, the oil may be smoothly supplied to the outer channel through the second oil channel B. At least one of the first oil channel A and the second oil channel B may be maintained in an open state. Further, sufficient oil may be supplied through the first oil channel A and the second oil channel B while oil is not accumulated therein.

Figure 7A:
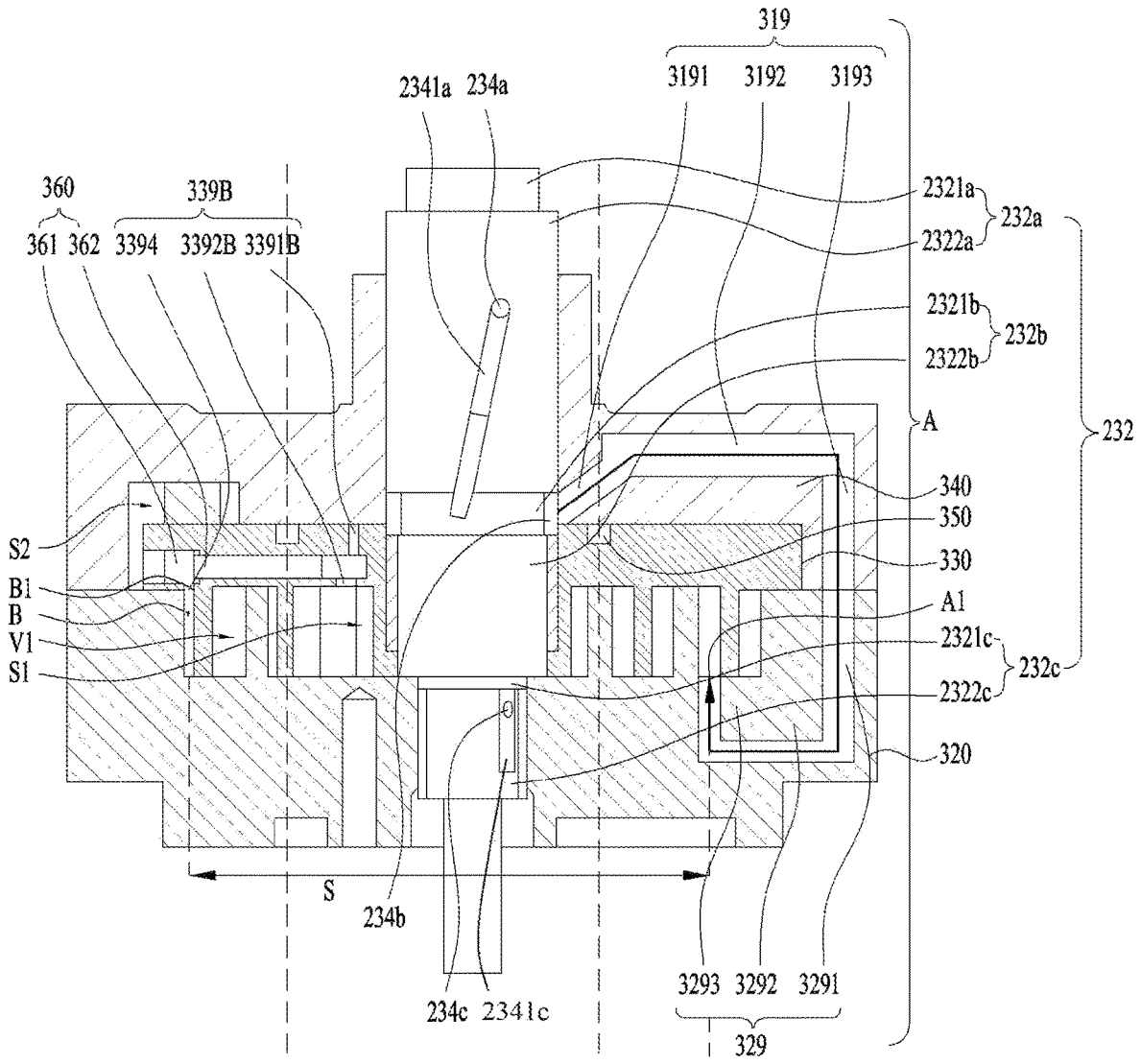
FIGS. 7A and 7B show still another embodiment of an oil feeding structure applied to the compressing assembly of the compressor according to the present disclosure.
Figure 7B:
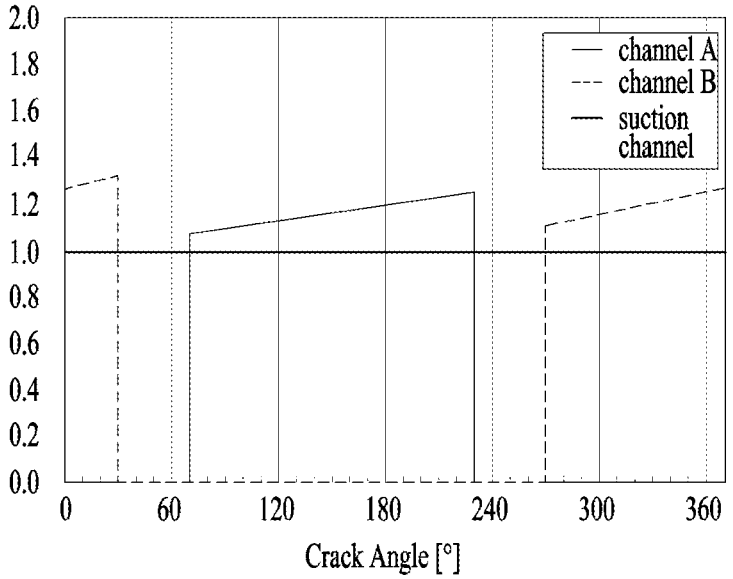

FIGS. 7A and 7B show another embodiment of the oil feeding structure of the compressor according to the present disclosure.

The oil feeding channel according to the present disclosure may include a first oil channel A passing through one of the orbiting scroll 330 and the fixed scroll 320 and a second oil channel passing through the other one of the orbiting scroll 330 and the fixed scroll 320.

FIGS. 7A and 7B show that the first oil channel A passes through the main frame 310 and the fixed scroll 320, and the second oil channel B passes through the orbiting scroll 330. This is merely one example. In another example, the second oil channel B passes through the main frame 310 and the fixed scroll 320, and the first oil channel A passes through the orbiting scroll 330.

The first oil channel A may include an oil transfer channel 319 which is defined in the main frame, and through along the oil supplied from the rotatable shaft flows, a fixed oil channel 329 defined in the fixed scroll and constructed to communicate with the oil transfer channel and including an outlet of the first oil channel that supplies the oil into a region between the orbiting wrap and the fixed wrap.

The second oil channel B may include an orbiting oil input channel 3191 which passes through the orbiting end plate and through which oil is injected into the orbiting scroll, a connection oil channel 3192 that extends from the orbiting oil input channel toward the outer circumferential face of the orbiting scroll, and a communication oil channel 3394 passing through the orbiting end plate and communicating the connection oil channel with the outlet of the second oil channel.

Even in this case, at least one of the outlet A1 ("first outlet") of the first oil channel and the outlet B1 ("second outlet") of the second oil channel may be kept open.

Further, since the second oil channel B is defined in the orbiting scroll 330 and does not pass through the fixed scroll 320, the oil channel resistance therein is smaller than that in the first oil channel A. Therefore, oil may be effectively supplied to the lower pressure region V2.

Further, at least one of the outlet A1 of the first oil channel and the outlet B1 of the second oil channel may be kept open regardless of the position of the fixed wrap 323 or orbiting wrap 333, and the oil feeding to the compressing assembly 300 may be prevented from being stopped.

FIGS. 8A to 8C show how the compressor operates according to the present disclosure.

FIG. 8A shows the orbiting scroll, FIG. 8B shows the fixed scroll, and FIG. 8C shows the process of compressing the refrigerant using the orbiting scroll and the fixed scroll.

The orbiting scroll 330 may include the orbiting wrap 333 on one face of the orbiting end plate 331, and the fixed scroll 320 may include the fixed wrap 323 on one face of the fixed end plate 321.

Further, the orbiting scroll 330 may be embodied as a sealed rigid body to prevent the refrigerant from being discharged out thereof.

In one example, the fixed wrap 323 and the orbiting wrap 333 may be formed in an involute shape and may be engaged with each other at two or more points to form a compression chamber in which the refrigerant is compressed.

The involute refers to a particular type of curve that is dependent on another shape or curve. An involute of a curve is the locus of a point on a piece of taut string as the string is either unwrapped from or wrapped around the curve.

However, according to the present disclosure, the fixed wrap 323 and the orbiting wrap 333 are formed by combining 20 or more arcs with each other. The radiuses of curvature of the arcs vary.

That is, the compressor according to the present disclosure is constructed so that the rotatable shaft 230 passes through the fixed scroll 320 and the orbiting scroll 330, so that the radius of curvature of the fixed wrap 323 and the orbiting wrap 333 and the compression space defined therebetween are reduced.

Therefore, to compensate for this reduction, in the compressor according to the present disclosure, the space in which the refrigerant is discharged to improve the compression ratio. To this end, the radius of curvature of a portion just before a portion of the fixed wrap 323 and the orbiting wrap 333 at which the refrigerant is discharged may be smaller than that of the shaft receiving portion receiving the rotatable shaft.

That is, the fixed wrap 323 and the orbiting wrap 333 may be curved at the smallest radius of curvature in the vicinity of the discharge hole 326, and the radius of curvature thereof may increase toward the inlet 325. The fixed wrap 323 and the orbiting wrap 333 have the varying radius of curvature between the discharge hole 326 and inlet 325.

Referring to FIG. 8C, refrigerant I flows into the inlet 325 of the fixed scroll 320, and refrigerant II flowing before the refrigerant I is located near the discharge hole 326 of the fixed scroll 320.

In this connection, the refrigerant I exists in a region in which the outer surfaces of the fixed wrap 323 and the orbiting wrap 333 are engaged with each other, and the refrigerant II is present and sealed in another region where the fixed wrap 323 and the orbiting wrap 333 are engaged with each other at two points thereof.

Then, when the orbiting scroll 330 starts orbiting, the region where the fixed wrap 323 and the orbiting wrap 333 are engaged with each other at the two points moves along the extension direction of the fixed wrap 323 and the orbiting wrap 333 according to the position change of the orbiting wrap 333, such that the volume of the refrigerant begins to be reduced. The refrigerant I is compressed. The refrigerant II is further reduced in volume and compressed and begins to be guided to the discharge hole 326.

The refrigerant II is discharged from the discharge hole 326, and the refrigerant I moves as the region where the fixed wrap 323 and the orbiting wrap 333 are engaged with each other at the two-points moves clockwise, and the volume thereof decreases and the refrigerant begins to be further compressed.

The region in which the fixed wrap 323 and the orbiting wrap 333 are engaged with each other at the two points moves clockwise again, and is closer to the inside of the fixed scroll, the volume thereof is further reduced and the refrigerant is compressed, and the refrigerant II is almost completely discharged.

In this way, as the orbiting scroll 330 orbits, the refrigerant may be compressed linearly or continuously while moving inside the fixed scroll.

The drawing shows that the refrigerant discontinuously flows into the inlet 325, but this is for illustration only. Alternatively, the refrigerant may be supplied continuously, and the refrigerant may be accommodated and compressed in the region defined by the two points at which the fixed wrap 323 and the orbiting wrap 333 are engaged with each other.

The present disclosure may be modified and implemented in various forms, and the scope of the rights thereof is not limited to the above-described embodiments. Therefore, when the modified embodiment includes the constituent elements of Claims the present disclosure, it should be regarded as belonging to the scope of the present disclosure.

What is claimed is:

1. A compressor comprising:

a casing comprising a discharger configured to discharge refrigerant to an outside of the casing, the casing defining an oil storage space configured to store oil therein;

a driver coupled to an inner circumferential surface of the casing;

a rotatable shaft coupled to the driver and configured to transport the oil; and a compressing assembly coupled to the rotatable shaft and configured to compress the refrigerant, the compressing assembly being configured to be lubricated with the oil, wherein the compressing assembly comprises:

an orbiting scroll comprising:

an orbiting end plate that supports the rotatable shaft rotatably and is configured to perform an orbiting motion about the rotatable shaft, and an orbiting wrap that extends along a circumferential direction of the orbiting end plate, a fixed scroll comprising:

a fixed end plate that defines a refrigerant inlet and a discharge hole spaced from the refrigerant inlet, and a fixed wrap that extends from the fixed end plate and faces the orbiting wrap, wherein the orbiting wrap and the fixed wrap are configured to compress the refrigerant, and the discharge hole is configured to discharge the compressed refrigerant, a main frame that is disposed at the fixed end plate and accommodates the orbiting scroll, wherein the rotatable shaft passes through the main frame, and an oil feeding channel that passes through the orbiting end plate and the fixed end plate and that is configured to supply the oil transported by the rotatable shaft into one or more regions between the orbiting wrap and the fixed wrap, the oil feeding channel comprising:

a first oil channel configured to supply the oil to a first region between the fixed wrap and the orbiting wrap, the first oil channel having a first outlet spaced apart from the rotatable shaft, and a second oil channel that is separate from the first oil channel and configured to supply the oil to a second region different from the first region, the second oil channel having a second outlet spaced apart from the rotatable shaft and defined radially outward relative to the first outlet with respect to the rotatable shaft, wherein the first oil channel and the second oil channel are spaced apart from each other by a spacing larger than a thickness of the orbiting wrap, and wherein at least a portion of the first outlet and the second outlet is configured to be blocked based on rotation of the orbiting wrap relative to the fixed wrap.

2. The compressor of claim 1, wherein the first outlet and the second outlet are spaced apart from each other, and wherein at least one of the first outlet or the second outlet is configured to remain open regardless of a position of the orbiting wrap relative to the fixed wrap.

3. The compressor of claim 1, wherein the first oil channel is disposed between an inner surface of the orbiting wrap and an outer surface of the fixed wrap, and wherein the second oil channel is disposed between an outer surface of the orbiting wrap and an inner surface of the fixed wrap.

4. The compressor of claim 1, wherein a diameter of each of the first outlet and the second outlet is less than a radial thickness of the fixed wrap or the orbiting wrap.

5. The compressor of claim 1, wherein the first oil channel passes through the fixed end plate, and the second oil channel passes through the orbiting end plate.

6. The compressor of claim 5, wherein the first oil channel comprises:

a first oil transfer channel defined in the main frame and configured to receive the oil supplied by the rotatable shaft; and a first fixed oil channel defined in the fixed scroll and configured to communicate the oil with the first oil transfer channel, the first fixed oil channel having the first outlet, and wherein the second oil channel comprises:

an orbiting oil input channel that passes through the orbiting end plate and is configured to provide the oil into the orbiting scroll, a connection oil channel that extends from the orbiting oil input channel toward an outer circumferential surface of the orbiting scroll, and a communication oil channel that passes through the orbiting end plate and is configured to communicate the oil with the connection oil channel and the second outlet.

7. The compressor of claim 6, wherein the first oil channel passes through the fixed end plate, and the second oil channel passes through the orbiting end plate.

8. The compressor of claim 1, wherein the first region and the second region are in fluid communication with each other and arranged next to each other in a radial direction of the rotatable shaft.

9. The compressor of claim 1, wherein the rotatable shaft defines an oil supply channel that extends upward from a bottom end of the rotatable shaft facing the oil storage space.

10. The compressor of claim 9, wherein the main frame defines an oil transfer channel that extends from an inner circumferential surface of the main frame facing an outer circumferential surface of the rotatable shaft, and wherein the rotatable shaft further defines an oil feeding hole that passes through the outer circumferential surface of the rotatable shaft and is configured to provide the oil from the oil supply channel to the oil transfer channel.

* * * * *